US010849389B1

(12) United States Patent
Darrow

(10) Patent No.: US 10,849,389 B1
(45) Date of Patent: Dec. 1, 2020

(54) DEVICE FOR ASSISTING LACE TIGHTENING

(71) Applicant: Kamiko L. Darrow, Weston, MA (US)

(72) Inventor: Kamiko L. Darrow, Weston, MA (US)

(73) Assignee: Kamiko L. Darrow, Weston, MA (US)

( * ) Notice: Subject to any disclaimer, the term of this patent is extended or adjusted under 35 U.S.C. 154(b) by 0 days.

(21) Appl. No.: 16/264,924

(22) Filed: Feb. 1, 2019

Related U.S. Application Data

(60) Provisional application No. 62/631,145, filed on Feb. 15, 2018.

(51) Int. Cl.

| | |
|---|---|
| ***A43C 11/00*** | (2006.01) |
| ***A43C 11/14*** | (2006.01) |
| ***A43C 11/16*** | (2006.01) |
| ***A47G 25/80*** | (2006.01) |

(52) U.S. Cl.
CPC ..... *A43C 11/14* (2013.01); *A43C 11/16* (2013.01); *A47G 25/80* (2013.01)

(58) Field of Classification Search
CPC ..... A43C 11/14; A43C 11/16; A47G 25/80
See application file for complete search history.

(56) References Cited

U.S. PATENT DOCUMENTS 8,865 A * 4/1852 Thomson ..... A47G 25/80 223/117
199,557 A * 1/1878 Lauffer ..... A47G 25/80 223/116
2,739,310 A * 3/1956 Frieder ..... A42B 3/14 2/418
4,193,171 A 3/1980 Lichowsky
4,261,081 A 4/1981 Lott
4,633,599 A * 1/1987 Morell ..... A43C 11/16 24/68 SK
4,771,768 A * 9/1988 Crispin ..... A61F 5/0127 602/16
5,069,202 A * 12/1991 Prock ..... A61F 5/0127 602/27
5,316,189 A 5/1994 Galeros et al.
5,325,613 A * 7/1994 Sussmann ..... A43C 11/00 24/712.2
5,335,401 A 8/1994 Hanson
5,467,511 A 11/1995 Kubo
5,572,777 A 11/1996 Shelton
5,695,164 A * 12/1997 Hartmann ..... B60R 11/00 248/206.4
5,822,887 A * 10/1998 Turner ..... A43B 7/1495 36/89
5,924,178 A 7/1999 Holmberg
6,077,241 A * 6/2000 Fareed ..... A61F 13/00 2/16

(Continued)

*Primary Examiner* — Jason W San
(74) *Attorney, Agent, or Firm* — Nutter McClennen & Fish LLP

(57) ABSTRACT

A device for assisting with tightening footwear laces includes a frame configured to at least partially surround a portion of the footwear. The footwear has laces and sidewalls. The device also includes at least two compression pads coupled to the frame. The compression pads are positioned so as to contact a respective sidewall of the footwear. The compression pads have a distance between them that is adjustable so as to cause the compression pads to press the sidewalls of the footwear inwardly.

20 Claims, 7 Drawing Sheets

(56) References Cited

U.S. PATENT DOCUMENTS 6,321,466 B1 * 11/2001 Bordin ..... A43B 5/0405 24/68 R
6,622,358 B1 9/2003 Christy
6,708,376 B1 * 3/2004 Landry ..... A42B 3/145 2/418
6,729,000 B1 5/2004 Liu
6,779,281 B1 8/2004 Liu
6,802,439 B2 10/2004 Azam et al.
6,817,070 B1 11/2004 Liu
6,898,826 B2 * 5/2005 Draper ..... A43C 11/1486 24/170
7,043,772 B2 * 5/2006 Bielefeld ..... A42B 3/145 2/418
7,076,843 B2 7/2006 Sakabayashi
7,096,559 B2 8/2006 Johnson
7,152,285 B2 12/2006 Liao
7,174,575 B1 * 2/2007 Scherer ..... A42B 3/145 2/418
7,292,149 B2 * 11/2007 Yasur ..... G08B 13/1445 24/68 R
7,565,704 B2 * 7/2009 Wu ..... A42B 3/145 2/410
7,713,225 B2 * 5/2010 Ingimundarson ..... A61F 5/0123 602/16
7,794,418 B2 * 9/2010 Ingimundarson ..... A61F 5/0123 602/23
7,887,082 B2 * 2/2011 Caslowitz ..... A43B 5/16 280/619
7,896,827 B2 * 3/2011 Ingimundarson ..... A61F 5/0123 602/23
7,908,771 B2 * 3/2011 Foxen ..... A43B 7/20 36/89
8,231,560 B2 * 7/2012 Ingimundarson ..... A61F 5/0123 602/20
8,370,967 B2 * 2/2013 Chen ..... A42B 3/145 2/414
8,434,200 B2 * 5/2013 Chen ..... A43C 11/165 2/418
8,578,521 B2 * 11/2013 Rogers ..... A42B 3/08 2/417
8,988,235 B2 * 3/2015 Burke ..... A61F 5/01 116/212
9,107,753 B2 * 8/2015 Lee ..... A61F 5/30
9,439,827 B2 * 9/2016 Saatchi ..... A61B 17/1325
9,498,368 B2 * 11/2016 Anglada ..... A61F 13/102
9,629,417 B2 * 4/2017 Cavanagh ..... A43C 11/165
9,707,119 B2 * 7/2017 Berns ..... A61F 13/066
9,730,497 B2 * 8/2017 Huynh ..... A44C 5/00
9,918,516 B1 * 3/2018 Hall ..... A43C 1/00
10,052,221 B2 * 8/2018 Albertsson ..... A61F 5/0109
10,092,297 B2 * 10/2018 Hoff ..... A61B 17/1325
10,092,439 B2 * 10/2018 Madden ..... A61F 5/0127
10,166,150 B2 * 1/2019 Norton ..... A61F 13/08
10,363,198 B2 * 7/2019 Salstein-Begley ..... A61H 39/04
10,455,900 B2 * 10/2019 Feinstein ..... A61F 5/0111
10,463,564 B2 * 11/2019 Chung ..... A61H 1/008
10,470,525 B2 * 11/2019 Chen ..... A43C 7/00
10,492,568 B2 * 12/2019 Burns ..... A45F 5/02
10,524,802 B2 * 1/2020 Kimura ..... A61B 17/1325
10,531,707 B2 * 1/2020 Lockwood ..... A43B 23/24
10,609,980 B2 * 4/2020 Weidl ..... A43B 3/246
2002/0013983 A1 2/2002 Choe
2003/0034365 A1 2/2003 Azam et al.
2004/0104380 A1 * 6/2004 Huang ..... A44B 11/125 254/218
2005/0050692 A1 * 3/2005 Shiue ..... A43C 11/14 24/68 R
2006/0005429 A1 1/2006 Min
2006/0021204 A1 2/2006 Young
2006/0037215 A1 * 2/2006 Lee ..... A43B 5/00 36/50.5
2006/0042056 A1 3/2006 Min
2006/0277726 A1 * 12/2006 Hsieh ..... B25B 25/00 24/68 R
2008/0060167 A1 * 3/2008 Hammerslag ..... A43B 5/16 24/68 SK
2008/0120819 A1 * 5/2008 Rene ..... A41D 1/005 24/68 R
2008/0189921 A1 * 8/2008 Tomosue ..... B60P 7/083 24/68 R
2008/0228117 A1 * 9/2008 Fareed ..... A61F 13/102 602/5
2010/0101061 A1 4/2010 Ha
2010/0139057 A1 * 6/2010 Soderberg ..... A43C 11/16 24/68 R
2010/0295004 A1 * 11/2010 Huang ..... B60P 7/0846 254/218
2011/0030244 A1 2/2011 Motawi et al.
2011/0099843 A1 5/2011 Jung
2011/0191992 A1 8/2011 Chen
2011/0289741 A1 * 12/2011 Moyer ..... B25B 25/00 24/68 CT
2012/0221041 A1 * 8/2012 Hansson ..... A61B 17/135 606/203
2013/0042446 A1 * 2/2013 Tseng ..... A41F 1/008 24/68 R
2013/0047384 A1 * 2/2013 Carnevali ..... B65D 63/1063 24/265 CD
2013/0239373 A1 9/2013 Strong
2014/0033485 A1 * 2/2014 Kingery ..... B66D 3/04 24/68 R
2015/0096123 A1 * 4/2015 Whaley ..... A47C 21/022 5/496
2015/0289594 A1 * 10/2015 Rushbrook ..... A43C 11/22 36/50.1
2018/0295943 A1 * 10/2018 Fallon ..... A43B 5/00
2019/0021446 A1 * 1/2019 Lee ..... A43C 11/16

* cited by examiner

DEVICE FOR ASSISTING LACE TIGHTENING

PRIORITY

This patent application claims priority from provisional U.S. patent application No. 62/631,145, filed Feb. 15, 2018, entitled, "DEVICE FOR ASSISTING LACE TIGHTENING," and naming Kamiko L. Darrow as inventor, the disclosure of which is incorporated herein, in its entirety, by reference.

FIELD OF THE INVENTION

The invention generally relates to footwear and, more particularly, the invention relates to a device that assists with the tightening of laces.

BACKGROUND OF THE INVENTION

Certain sports activities require specialized footwear that has laces, for example, hockey skates and snowboard boots. This specialized footwear is generally stiffer than normal walking shoes, which makes it difficult to tightly lace. This can be especially difficult for children, who often lack the upper body strength and dexterity needed to easily lace skates.

SUMMARY OF VARIOUS EMBODIMENTS

In accordance with one embodiment of the invention, a device for assisting with tightening footwear laces includes a frame configured to at least partially surround a portion of the footwear. The footwear has laces and sidewalls. The device also includes at least two compression pads coupled to the frame. The compression pads are positioned to contact a respective sidewall of the footwear. The compression pads have a distance between them that is adjustable to cause the compression pads to press the sidewalls of the footwear inwardly.

In some embodiments, the frame may be adjusted to decrease the distance between the compression pads. Among other things, the frame may include a strap that can be tightened. A ratchet mechanism may be used to keep the strap in a tightened position. The frame may also be adjusted by turning a knob, which may be coupled to a worm gear.

Additionally, or alternatively, the distance between the compression pads may be adjusted by moving at least one of the compression pads. To that end, a threaded bolt may be coupled to a knob that moves the position of the at least one compression pad relative to the frame. In some embodiments, the distance may be adjusted by inflating the at least one compression pad with a fluid pump.

In some embodiments, the device may be integrated into the footwear. Among other things, the footwear may include an ice skate or a snowboard boot.

In accordance with another embodiment, a method for tightening footwear laces provides a frame configured to at least partially surround a portion of the footwear. The method also provides at least two compression pads coupled to the frame. The compression pads have a distance between them and are positioned to contact a respective sidewall of the footwear. The distance between the compression pads is adjustable to cause the compression pads to press the sidewalls of the footwear inwardly. The method then positions the frame around the footwear, and positions the compression pads to overlap at least a portion of the respective sidewall. Then, the method presses the sidewalls inwardly by decreasing the distance between the compression pads.

After the sidewalls are compressed, the laces can be tightened. To that end, the compression pads may not overlap with the laces. In some embodiments, the frame may completely surround the portion of the footwear.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a device is configured to compress the sides of footwear having rigid sidewalls, such as ice skates, to assist with lace tying. The device compresses the sidewalls into the appropriate position to allow proper tightening of laces. After the laces are tightened, the device is released from the shoe and removed from the device. Details of illustrative embodiments are discussed below.

FIGS. 1A-1G schematically show an embodiment of a device 100 for tightening laces in accordance with illustrative embodiments of the invention.

Figure 1A:
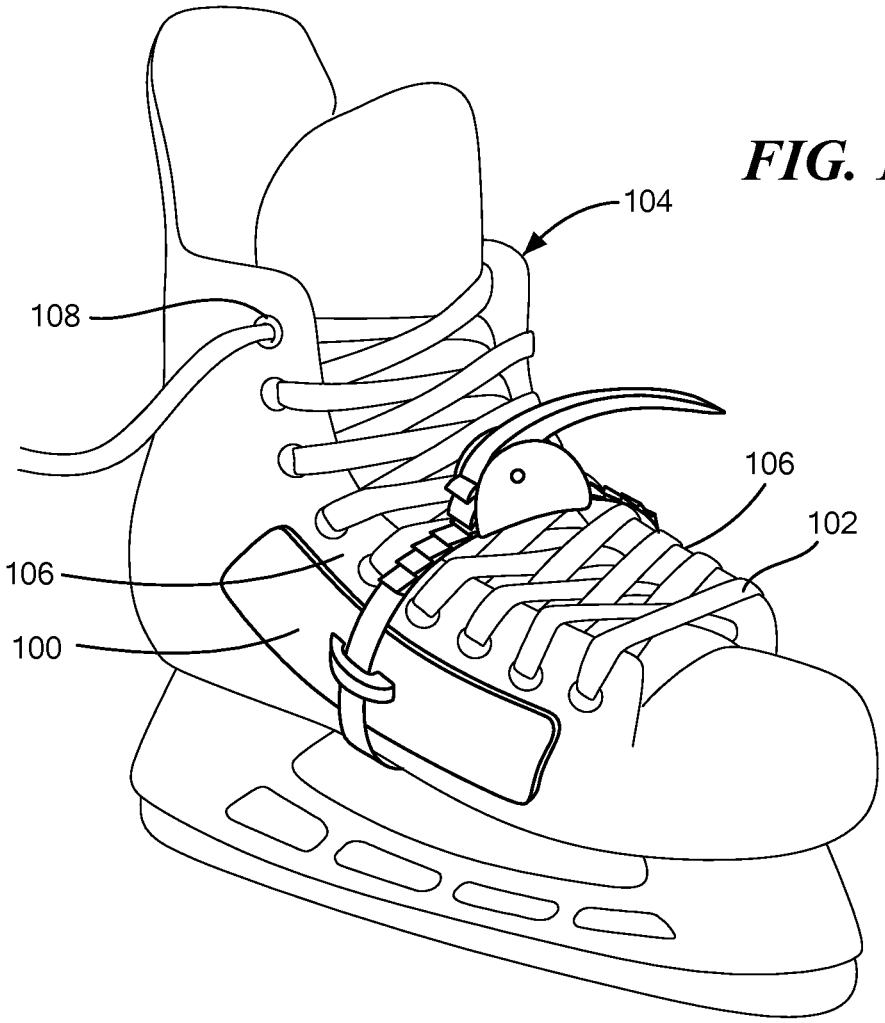
FIG. 1A schematically shows a device that assists with tightening laces, in accordance with illustrative embodiments of the invention.

Specifically, FIG. 1A schematically shows the device 100, which assists with tightening laces 102 on footwear 104 (e.g., skate 104), in accordance with illustrative embodiments of the invention. The skate 104, like many skates known in the art, has sidewalls 106 that are stiff and have slots and/or hooks 108 through which the laces 102 are looped. To optimize performance, users (e.g., adult or child athletes) generally tighten the laces 102 within some comfortable parameters. Tightening the laces 102 brings the sidewalls 106 closer together, and provides proper ankle support during athletic movements.

However, in athletic footwear 104, the sidewalls 106 are frequently not in an ideal position for lacing when the user's foot is positioned inside. Specifically, the sidewalls 106 need to be pressed closer together than they are in their resting position. Users generally pull aggressively on the laces 102 to tighten the laces and bring the sidewalls 106 closer together. Then the user ties the laces 102 in this tightened position. However, pulling on the laces 102 creates friction between the laces 102 and the slots and/or hooks 108, which creates wear and tear on the laces 102. After the laces 102 are worn down, they have to be replaced. Additionally, it is difficult to tighten the laces 102 because of the force necessary, and the resulting friction from pulling on the laces 102 may cause hand-blisters.

Illustrative embodiments of the device 100 compress the sidewalls 106 and reduce the friction generated when tightening laces 102. This, in turn, allows users to put the sidewalls 106 into the appropriate position without aggressively pulling on the laces 102. Thus, the laces 102 typically are not nearly as worn down as they are when tightening conventional skates 104 without the device 100, and tightening the laces 102 requires considerably less force—resulting in more comfort to the user.

Figure 1B:
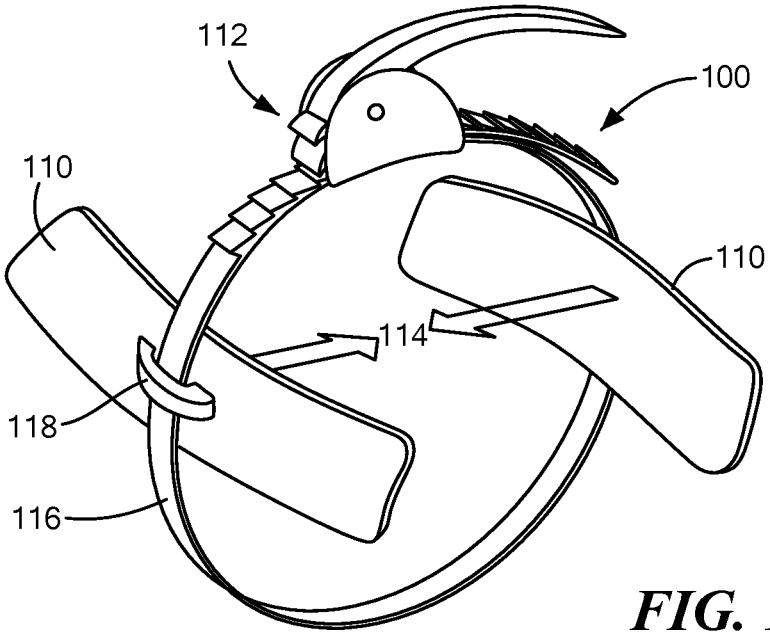
FIG. 1B schematically shows a stand-alone perspective view of the device of FIG. 1A.

FIG. 1B schematically shows a stand-alone perspective view of the device 100 of FIG. 1A. Illustrative embodiments have one or more compression pads 110 configured to compress the footwear 104. Specifically, in illustrative embodiments the compression pads 110 compress one or more sidewall 106 of the footwear 104. The compression pads 110 are shaped to compress the walls 106 of the skate 104 (e.g., illustrative embodiments have a surface area that roughly spans the length of the sidewall 106). As described previously, compressing the sidewall 106 allows the laces 102 to be tightened without the friction that normally results when tightening the laces 102. To that end, the user may adjust the amount of compression 114. For example, the device 100 may use a ratchet 112 configuration to adjust the amount of compression 114.

To adjust the amount of compression 114, the device 100 may have a strap 116 that wraps around the skate 104 (the strap 116 is generally referred to as a frame 116). The compression pads 110 are coupled to the ratchet strap 116 and hug both sides of the skate 104 when the strap 116 is wrapped around the skate 104. To account for various shoe sizes, the compression pads 110 may be movably coupled with the strap 116 (e.g., via a loop 118). In alternative embodiments the compression pad 110 may be in a fixed in position relative to the strap 116.

Figure 1C:
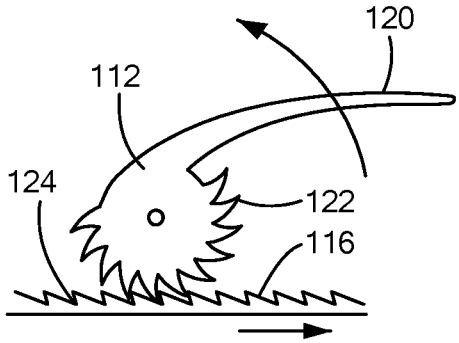
FIG. 1C-1D schematically show a close-up of the ratchet configuration of FIG. 1A.
Figure 1D:
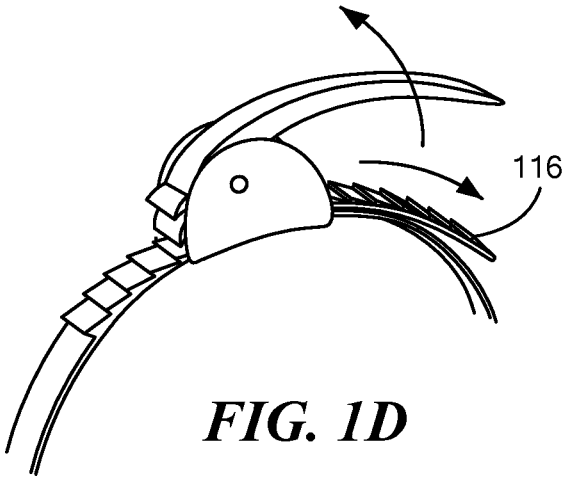
Figure 1E:
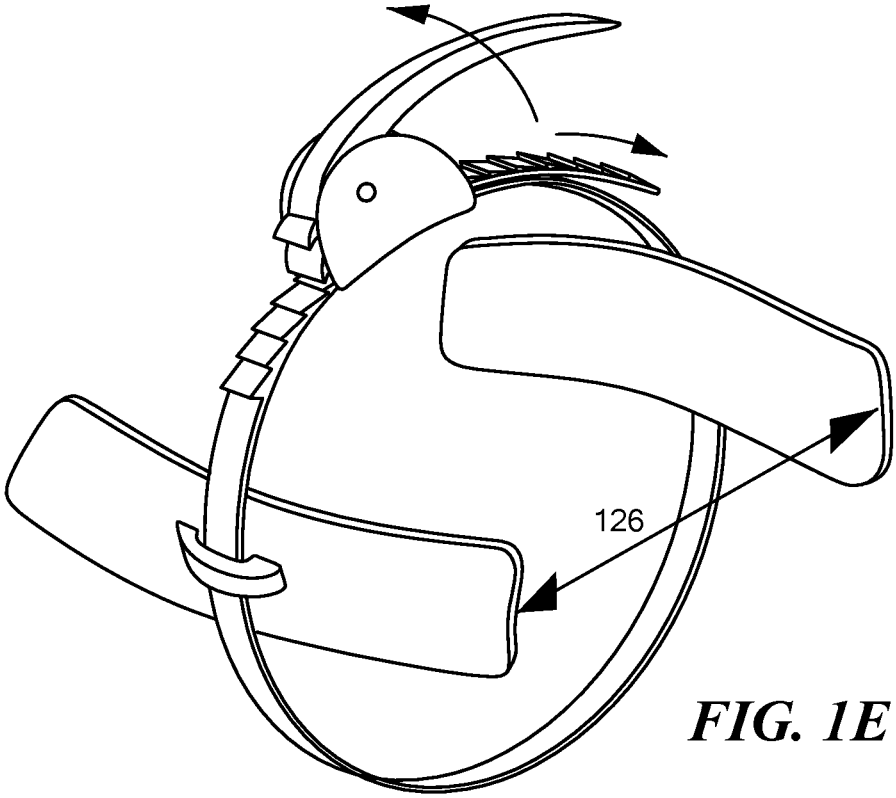
FIG. 1E schematically shows a perspective side view of the device of FIG. 1A.

FIG. 1C schematically shows a close-up of the ratchet 112 configuration. As the ratchet 112 handle 120 is pushed upwards, the teeth 122 on the base of the ratchet 112 fit into track like grooves 124 to make the strap 116 circumference smaller. As the strap 116 circumference shrinks (see FIG. 1D—where the end of the strap is fed through the ratchet mechanism), the distance 126 between the compression pads 110 decreases and the sides of the shoe are compressed (see FIG. 1E). The compression of the sides of the shoe 104 bring the walls 106 closer together, in turn reducing the friction between the laces 102 and the shoe 104, making the laces 102 easier to pull on (e.g., by reducing friction and resistance). The device 100 compresses 114 the walls 106 of the shoe 104, and the user then tightens the laces 102 to provide a secure shoe fit.

Figure 1F:
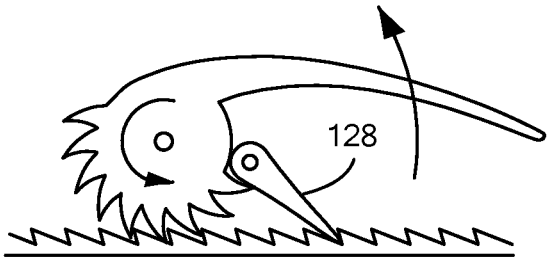
FIGS. 1F-1G schematically show a close-up of the ratchet configuration of FIG. 1 with a locking mechanism.
Figure 1G:
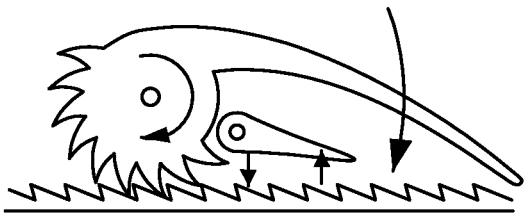

FIG. 1F schematically shows a close-up of the ratchet 112 having a locking mechanism 128. The locking mechanism 128 ensures that the ratchet 112 remains in the appropriate location until another turn of the handle 120 brings the ratchet 112 to another position, or until the ratchet mechanism is released. FIG. 1G schematically shows how to release the strap 116 from the ratchet 112. Pushing down on the handle 120 engages a spring that releases the locking mechanism 128 and allows the teeth 122 to disengage from the groove 124, thereby allowing the strap to be loosened and/or removed from the shoe 104.

Figure 2B:
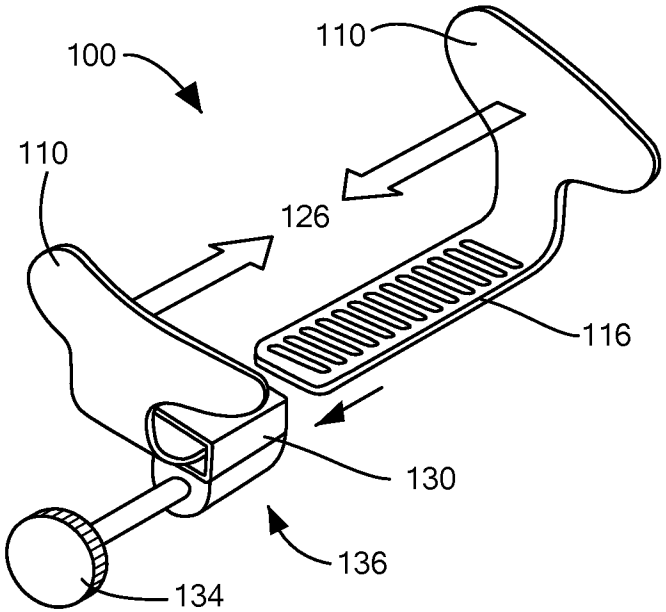
FIG. 2B schematically shows an exploded view of the device of FIG. 2A.
Figure 2A:
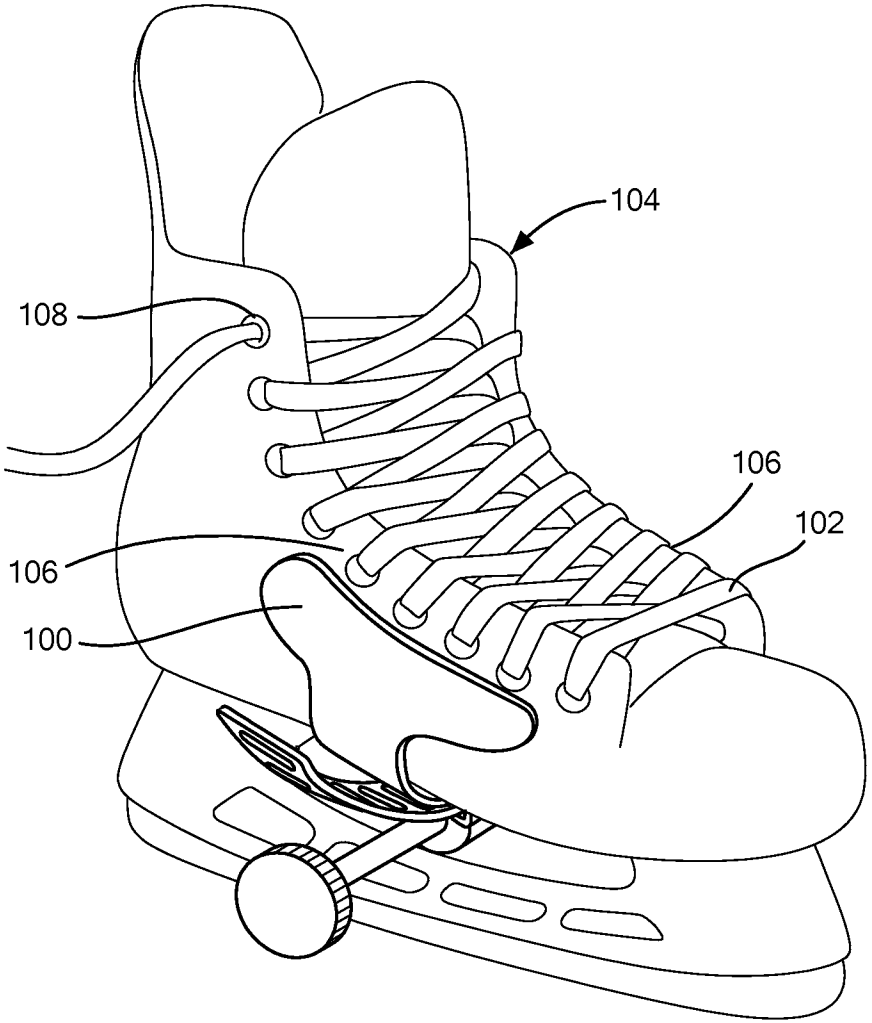
FIG. 2A schematically shows an alternative embodiment of the device that assists with tightening laces, in accordance with illustrative embodiments of the invention.

FIGS. 2A-2E schematically show an alternative embodiment of the device 100 for tightening laces 102 in accordance with illustrative embodiments of the invention. FIG. 2A schematically shows the device 100 that assists with tightening laces 102 on footwear 104 (e.g., skate 104), in accordance with illustrative embodiments of the invention. In some embodiments, the device 100 attaches to the skate 104 without overlapping with the laces 102 (e.g., with the top of the shoe 104).

FIG. 2B schematically shows an exploded view of the device 100 of FIG. 2A. The device 100 has a tightening mechanism 136 that reduces the distance 126 between compression pads 110. In illustrative embodiments, the strap 116 (also referred to as a track 116) is fed into a housing 130 containing a worm gear 132 coupled to a knob 134. Thus, the distance between the compression pads 110 is reduces.

Figure 2C:
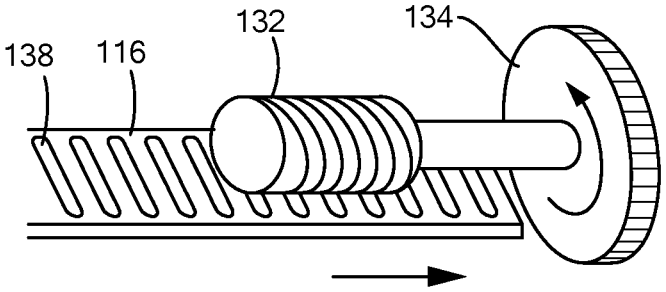
FIGS. 2C-2D schematically show internal details of the housing of FIG. 2B.
Figure 2D:
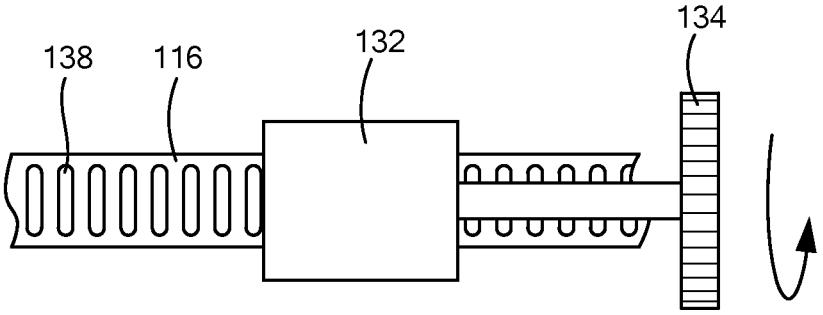

FIGS. 2C-2D schematically show details of the tightening mechanism 136 of FIG. 2A. The worm gear 132 inside the housing 130 fits in the track 116 holes 138. As the handle/knob 134 attached to the worm gear 132 rotates, the worm gear 132 latches onto the hole 138 and moves the track 116 forward to shrink the distance 126 between the compression pads 110. The left and right compression pad 110 work to move the sidewalls 106 of the shoe 104 closer together as a result of reducing the distance 126.

Figure 2E:
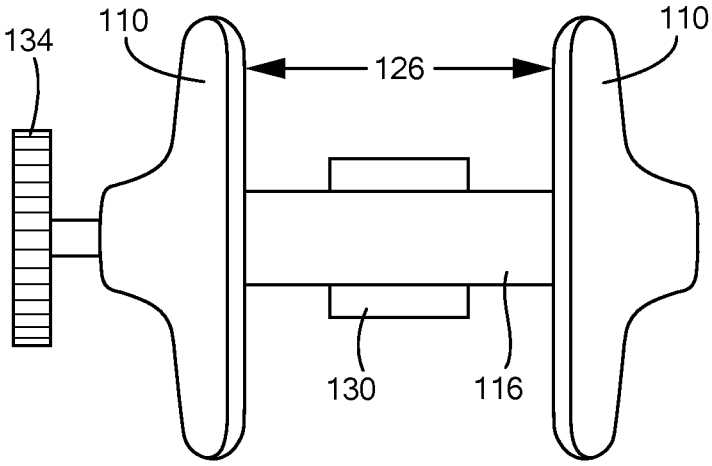
FIG. 2E schematically shows a stand-alone front view of the device of FIG. 2A.

FIG. 2E schematically shows an assembled view of the device 100 of FIG. 2B. When the distance 126 is reduced, the sidewalls 106 of the shoe 104 are compressed. As described earlier, when the sidewalls 106 are closer to one another, the laces 102 are loose and easy to pull into place to ensure the compressed shoe 104 stays in the new secure position for a snug fit. The pads 110 are designed to fit the contours of the shoe 104 and the user's foot. As the pads 110 work to compress the shoe 104, they are configured to compress the appropriate points on the sidewalls 106 of to maximize foot support. To decompress the device 100, rotate the handle 134 the opposite direction thereby increasing the distance between the left pad and the right pad loosening the device from the shoe. Conversely, after the laces 102 are tied to support the compressed position of the shoe 104, turning the handle 134 in the opposite direction increases the distance 126 and facilitates removal of the device from the shoe.

FIGS. 3A-3F schematically show an alternative embodiment of the device 100 for tightening laces 102. In this embodiment, the device 100 attaches to the skate 104 without overlapping with the laces 102 (e.g., with the top of the shoe 104).

Figure 3B:
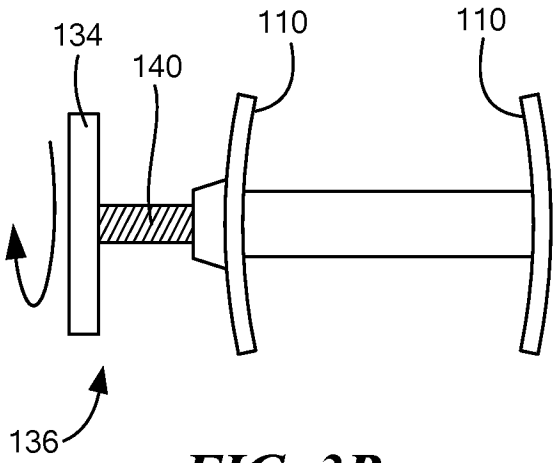
FIG. 3A-3D schematically show an alternative embodiment of the device that assists with tightening laces, in accordance with illustrative embodiments of the invention.
Figure 3A:
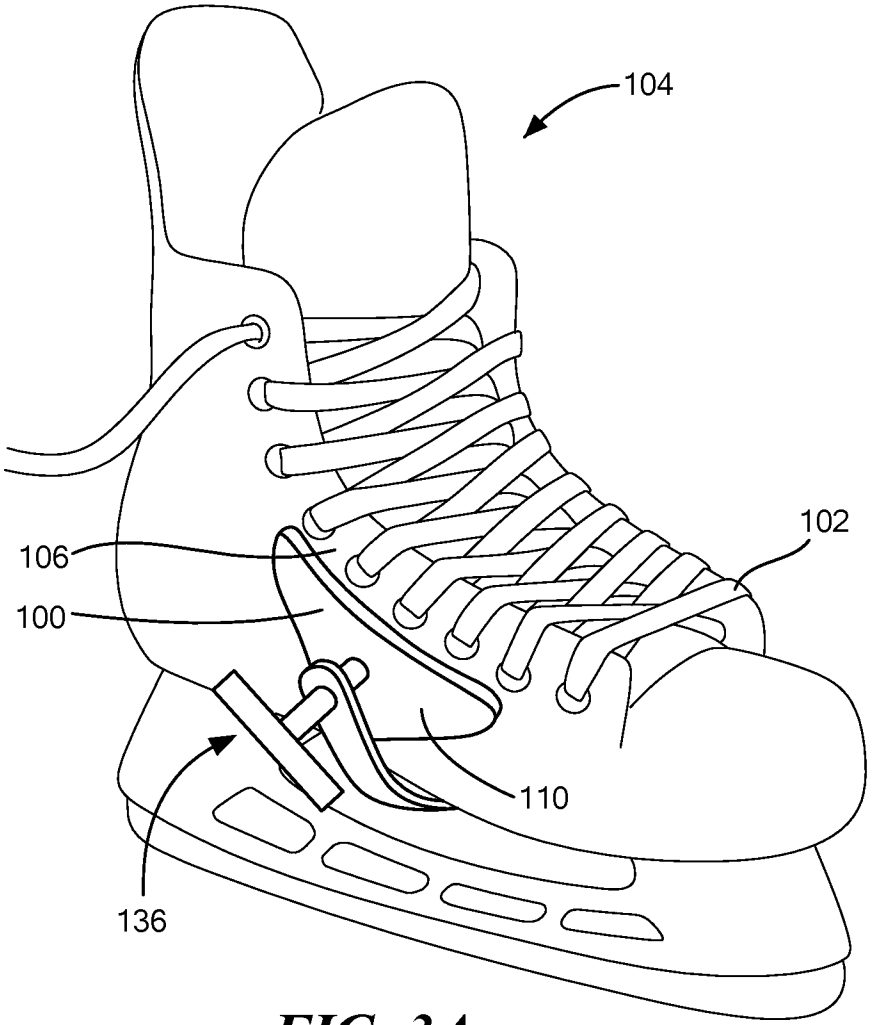
Figure 3C:
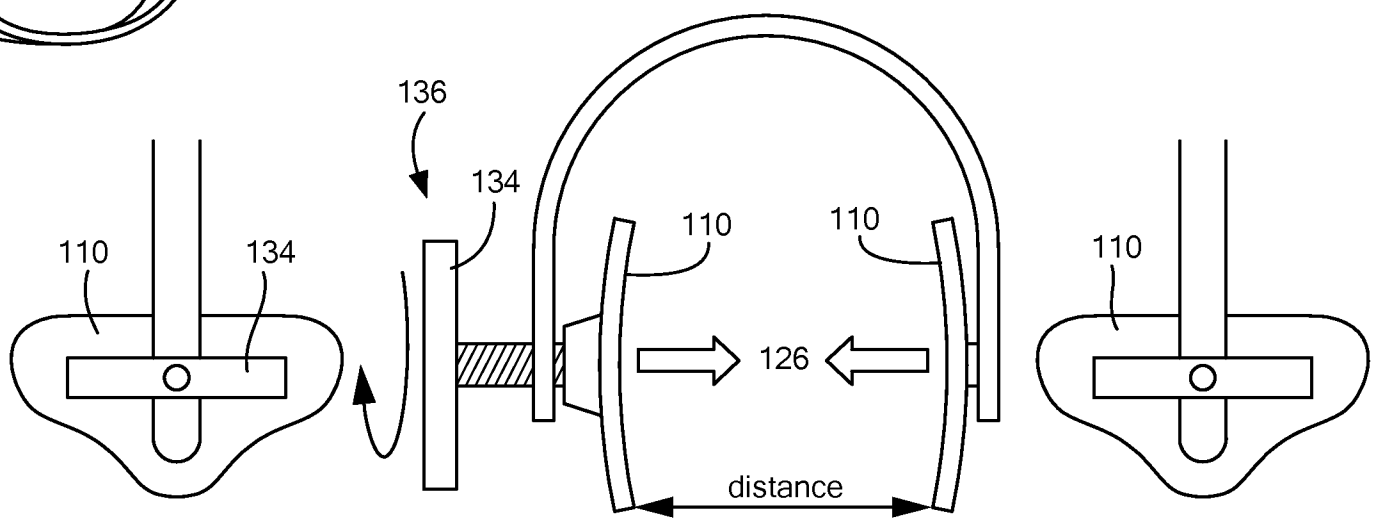

FIG. 3A schematically shows the device 100 that assists with tightening laces 102 on footwear 104 (e.g., skate 104), in accordance with alternative embodiments of the invention. The compression device 100 hugs the skate 104 without blocking the laces 102. FIG. 3B schematically shows an alternative tightening mechanism 136. In illustrative embodiments, the tightening mechanism 136 includes a threaded bolt 140 that is coupled to the handle 134.

When the handle 134 rotates, the right pad 110 moves closer to the left pad 110. As a result, the distance 126 between the left pad 110 and the right pad 110 shrinks (see FIG. 3C). The right pad 110 and the left pad 110 contact the sidewalls 106 of the skate. When the distance 126 between the pads 110 shrink, so does the distance between the outer walls 106 of the shoe 104: the walls 106 of the shoe are compressed to provide the foot support needed. When the compression takes place, the laces 102 are generally loose, allowing the user to pull the laces 102 and tie them in place to ensure the compressed sidewalls 106 remain in position to provide maximum support. To decompress the sidewalls 106 of the shoe 104, the handle 134 may be rotated in the opposite direction, thereby increasing the distance between the left pad 110 and the right pad 110.

Figure 3D:
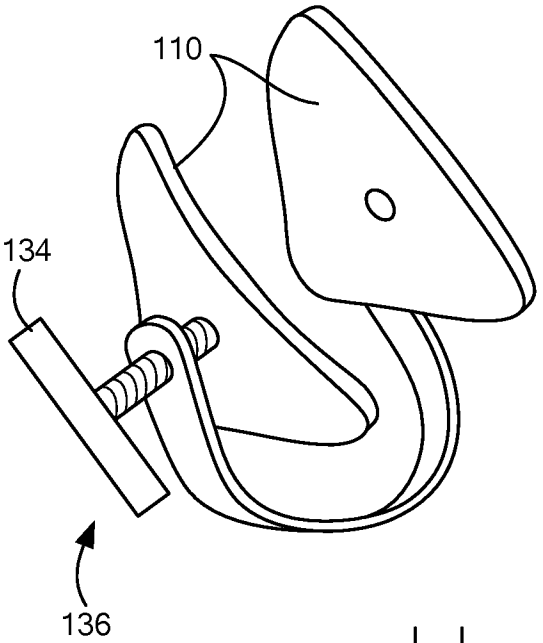

FIG. 3D schematically shows a perspective view of the device of FIG. 3A. After the laces 102 are tied to support the compressed position of the shoe 104, the handle 134 is turned to loosen the device 100, so that the device may be removed from the shoe 104.

Figure 4B:
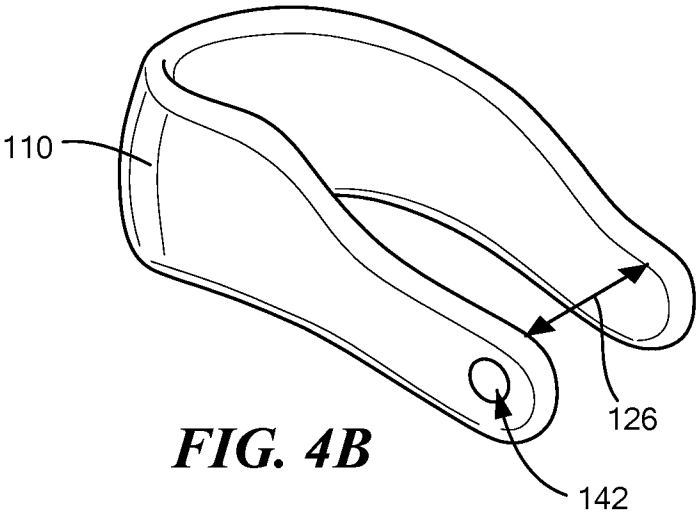
FIGS. 4A-4C schematically show yet another alternative embodiment of the device that assists with tightening laces, in accordance with illustrative embodiments of the invention.
Figure 4C:
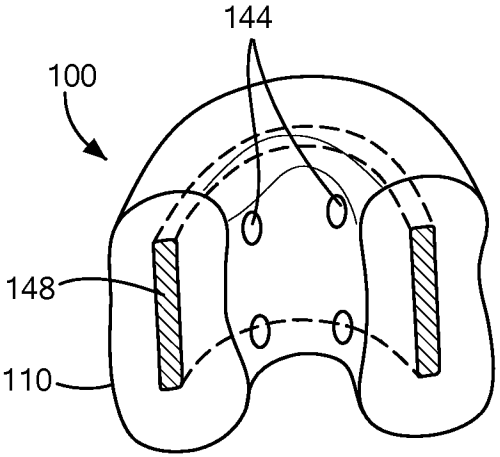
Figure 4A:
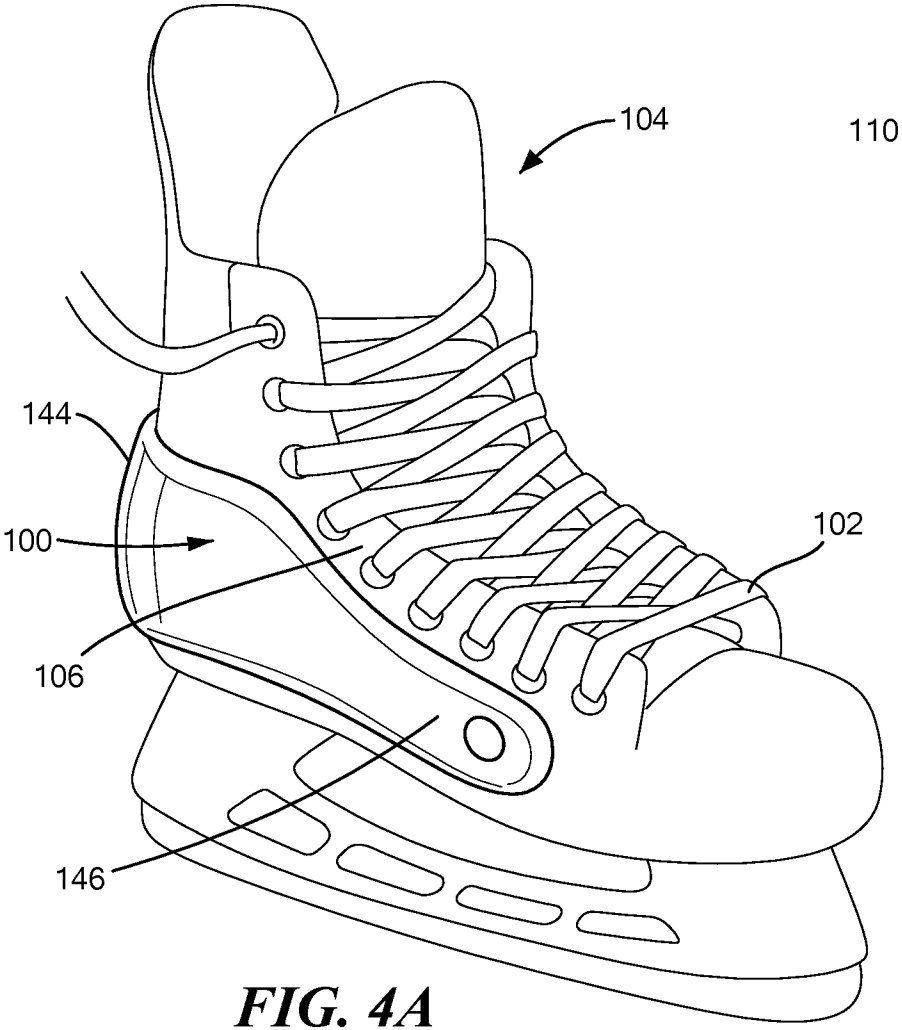

FIGS. 4A-4C schematically show an alternative embodiment of the device 100 for tightening laces 102 in accordance with illustrative embodiments of the invention. FIG. 4A schematically shows the device 100 that assists with tightening laces 102, in accordance with illustrative embodiments of the invention In illustrative embodiments, the device 100 uses fluid to compress the sidewalls 106 of the shoe 104. The device 100 may be attached to an outside source of fluid (e.g., a water line or compressed air tank), or may have its own self-contained fluid reservoir.

FIG. 4B shows a perspective view of the device 100 of FIG. 4A. A button 142 may be used to activate a pump 144 that moves fluid (e.g., air or liquid) into the compression pad 110 of the device 100. In some embodiments, fluid may be moved just into the compression portion 146 that is at or near the sidewall 106 (e.g., from the self-contained fluid reservoir). As the fluid is pumped into the compression pad 110 (or portions thereof), the distance 126 between the left and right side of the device 100 decreases. Inflation of the device 100, when the device is mounted to the shoe 104, forces the sidewalls 106 of the shoe 104 to come closer together, compressing the shoe 104 and making tightening of the laces 102 easier.

In illustrative embodiments, pushing the button 142 also releases the fluid from the compression pad 110 (or portions 146 thereof) and deflates the device 100. Thus, the button 142 may act as a start/stop for the fluid pump 144. When the compression pad 110 is deflated, the distance 126 decreases, thereby decompressing the sidewalls 106 if the laces 102 are not tied. After the laces 102 are tied to support the compressed position of the shoe, the compression pad 110 may be decompressed to facilitate removal of the device 100 from the footwear 104.

FIG. 4C schematically shows internal components of the device of FIGS. 4A-4B. In some embodiments, the compression may be automatically regulated. An automated version of this device may have sensors 144 that control the fluid pump 144 to achieve a desired pressure internal to the compression pad 110. Additionally, some embodiments may contain a rigid internal support 148.

It should be understood that various embodiments of the device may have one or more compression pads. In some embodiments, the compression pad and the frame may be integrated, and portions of that pad may be moved or inflated. In some embodiments, one or more pads 110 may be moved and/or one or more pads 110 may be inflated. In some embodiments, the device may be integrated into the footwear.

In illustrative embodiments, the frame of the device may be made out of a metal, plastic and/or carbon fiber composite, among other things. In some embodiments, the frame may be internal to the compression pad. Furthermore, the compression pads may be formed from a metal, plastic, or carbon fiber composite.

Various embodiments of the invention enable children and people with upper extremity dysfunction to more easily and independently lace up their skates and other forms of footwear, particularly a design that can compress the sidewalls of the athletic footwear. Another advantage of some embodiments may include reducing the amount of force needed to compress the sidewalls of the athletic shoe for proper lace tightening. Illustrative embodiments of the device may instill confidence in children because they will be able to properly tighten their own skates without assistance from an adult. Similarly, illustrative embodiments may enable those with upper extremity disabilities to independently put on their footwear. Furthermore, another potential advantage of illustrative embodiments is a decrease on the wear and tear of laces, such that replacement laces are purchased less frequently.

Although the above discussion discloses various exemplary embodiments of the invention, it should be apparent that those skilled in the art can make various modifications that will achieve some of the advantages of the invention without departing from the true scope of the invention.

What is claimed is:

1. A system for compressing footwear to ease tightening of footwear laces, the system comprising:

footwear having sidewalls; and a device comprising:

a frame configured to at least partially surround a portion of the footwear that includes sidewalls, at least two compression pads coupled to the frame, the compression pads configured to contact and compress a respective sidewall of the footwear when the frame at least partially surrounds the portion of the footwear that includes the sidewalls, the compression pads having a distance between them at rest, the distance between the compression pads being adjustable to press the sidewalls of the footwear inwardly, the device configured so that decreasing the distance between the compression pads reduces friction on the laces when the laces are tightened.

2. The system as defined by claim 1, wherein the frame completely surrounds the portion of the footwear.

3. The system as defined by claim 1, wherein the frame adjusts to decrease the distance between the compression pads.

4. The system as defined by claim 3, wherein the frame comprises a strap that is tightened.

5. The system as defined by claim 4, further comprising a ratchet mechanism that keeps the strap tightened.

6. The system as defined by claim 3, wherein the frame is adjusted by a knob.

7. The system as defined by claim 6, wherein the knob is coupled to a worm gear.

8. The system as defined by claim 1, wherein the distance between the compression pads is adjusted by moving at least one compression pad.

9. The system as defined by claim 8, wherein a threaded bolt coupled to a knob moves the position of the at least one compression pad.

10. The system as defined by claim 1, wherein the distance is adjusted by inflating at least one compression pad with a fluid pump.

11. The system as defined by claim 1, wherein the footwear is an ice skate or a snowboard boot.

12. A method for compressing footwear to ease tightening of laces for footwear, the footwear having laces and sidewalls, the method comprising:

providing a frame configured to at least partially surround a portion of the footwear that includes sidewalls, and at least two compression pads coupled to the frame, the compression pads having a distance between them at rest and positioned so as to contact a respective sidewall of the footwear, wherein the distance between the compression pads is adjustable to press the sidewalls of the footwear inwardly, positioning the frame around the footwear, and positioning the compression pads to overlap at least a portion of the respective sidewall of the footwear, pressing the sidewalls of the footwear inwardly by decreasing the distance between the compression pads to reduce friction on the laces when the laces are tightened, tightening the laces of the footwear after pressing the sidewalls inwardly.

13. The method as defined by claim 12, wherein the compression pads do not overlap with the laces.

14. The method as defined by claim 12, wherein the frame is adjusted to decrease the distance between the compression pads.

15. The method as defined by claim 14, wherein a handle coupled to a ratchet is used to decrease the distance.

16. The method as defined by claim 12, wherein the distance between the compression pads is adjusted by moving at least one compression pad.

17. The device as defined by claim 16, wherein a threaded bolt coupled to a knob moves the position of the at least one compression pad.

18. Footwear comprising:

a frame configured to at least partially surround a portion of the footwear that includes sidewalls;

at least two compression pads coupled to the frame, the compression pads configured to contact and compress a respective sidewall of the footwear when the frame at least partially surrounds the portion of the footwear that includes the sidewalls, the compression pads having a distance between them at rest, the distance between the compression pads being adjustable to press the sidewalls of the footwear inwardly, the device configured so that decreasing the distance between the compression pads reduces friction on the laces when the laces are tightened.

19. The footwear of claim 18, wherein the footwear comprises an ice skate or a snowboard boot.

20. The system as defined by claim 1, wherein a force is provided from outside the compression pads to adjust the distance between the compression pads.

* * * * *